United States Patent [19]

Tamaru et al.

[11] 4,302,243

[45] Nov. 24, 1981

[54] PROCESS FOR PRODUCING TANTALUM CONCENTRATES

[75] Inventors: Akio Tamaru; Minoru Kitsunai, both of Kitakyushu, Japan

[73] Assignee: Mitsubishi Chemical Industries, Ltd., Tokyo, Japan

[21] Appl. No.: 158,443

[22] Filed: Jun. 11, 1980

[30] Foreign Application Priority Data

Jun. 19, 1979 [JP] Japan ..... 54-77124

[51] Int. Cl.[3] ..... C22B 3/00; C22B 34/20

[52] U.S. Cl. ..... 75/1 T; 75/101 R; 75/115; 75/121; 423/62; 423/66; 423/68; 423/82

[58] Field of Search ..... 75/1 R, 1 T, 103, 108, 75/109, 115, 84; 423/62, 66, 67, 68, 82, 85, 86

[56] References Cited

U.S. PATENT DOCUMENTS

| | | | |
|---|---|---|---|
| 2,537,316 | 1/1951 | Gjessing et al. | 423/66 |
| 3,003,867 | 10/1961 | Lerner | 75/115 |
| 3,105,755 | 10/1963 | Green | 75/1 TI |
| 3,107,976 | 10/1963 | Koerner et al. | 423/66 |

OTHER PUBLICATIONS

Mellor, J. W.; *A Comprehensive Treatise on Inorganic and Theoretical Chemistry* vol. 9, Longmans, Green and Co., pp. 840–843 (1929).

Fairbrother F., *The Chemistry of Niobium and Tantalum* Elserier Pub. Co. pp. 52–55, 64–67, 70–71 (1967).

Ehret, W. F., *Smith's College Chemistry,* 6th Edition D. Appleton—Century Co., Inc. pp. 288–289 (1946).

Chemical Abstracts vol. 54, No. 4292(u) (1960).

*Primary Examiner*—Michael L. Lewis

*Attorney, Agent, or Firm*—Kenway & Jenney

[57] ABSTRACT

In a process for producing tantalum concentrates from ores containing tantalum oxides, tantalic acid or its salts together with rutile type titanium dioxide in mixed crystals, the ores are treated in a sulfuric acid of a concentration not lower than 50% by weight with heating at a temperature from 200° C. to the boiling point of said sulfuric acid, and then the above-treated products are treated with a reducing agent in an aqueous solution of sulfuric acid of a concentration lower than 50% by weight to dissolve the titanium component to thereby obtain tantalum concentrates as solid products.

21 Claims, No Drawings

PROCESS FOR PRODUCING TANTALUM CONCENTRATES

BACKGROUND OF THE INVENTION

1. Field of the Invention

This invention concerns a process for producing tantalum concentrates. More particularly, it relates to a process for producing tantalum concentrates from tantalum-containing ores which contain tantalum oxide, tantalic acid or its salts in combination with rutile type titanium dioxide in mixed crystals.

2. Description of the Prior Art

Tantalum containing ores include tantalite, columbite and tantalocolumbite which contain relatively high tantalum content and little or no titanium content, as well as those such as strüverite and ilumenorutile which have a relatively low tantalum content and further contain titanium as rutile type titanium dioxide.

Although a process for producing tantalum from the former type ores by using hydrofluoric acid has been known, the process including the use of hydrofluoric acid is unsuitable for the industrial production of tantalum from the latter type ores, since the latter ores have only low tantalum contents and require a great amount of expensive hydrofluoric acid.

In one prior art process for recovering niobium and tantalum values from ores containing metallic impurities such as titanium, the orese are first decomposed with an acid decomposition agent, next a strong reducing agent such as zinc is added to the resultant liquid decomposition product to reduce to soluble compounds and lastly niobium and tantalum values are precipitated from the liquid portion of the reduced decomposition product by hydrolysis (U.S. Pat. No. 2,537,316). In this process, since metallic sulfate is dissolved in the sulfuric acid, it is impossible to recover and reuse the excess sulfuric acid. Therefore, this process is also industrially disadvantageous.

The present inventors have made various studies of the industrial production of tantalum concentrates using ores containing tantalum oxide, tantalic acid or salts thereof in combination with rutile type titanium dioxide in mixed crystals (hereinafter referred to simply as tantalum ores) as the raw ores and, as the result, have discovered that the titanium components contained in the tantalum ores can effectively be dissolved into a diluted sulfuric acid and concentrates containing enriched tantalum concentrates can be obtained as solids, by treating the tantalum ores with concentrated sulfuric acid under specific conditions and reducing the products thus treated in the diluted sulfuric acid.

SUMMARY OF THE INVENTION

Accordingly, it is an object of this invention to provide an economically satisfactory process to produce tantalum concentrates effectively from tantalum ores by using sulfuric acid of much lower price than hydrofluoric acid.

The above-mentioned object of this invention can be attained by a process for producing tantalum concentrates effectively from tantalum ores, wherein the tantalum ores are at first heated at a temperature above 200° C. in sulfuric acid of a concentration not lower than 50% by weight and then the treated products are reduced in a sulfuric acid of a concentration lower than 50% by weight using a reducing agent to dissolve the titanium component and thereby obtain the tantalum concentrates as solids.

DETAILED DESCRIPTION OF THE INVENTION

The tantalum ores usable as the raw materials in this invention are those ores containing tantalum oxide, tantalic acid or its salts in combination with rutile type titanium oxides in mixed crystals. Among those ores, it is preferable to use ores of a comparative low content of tantalum component.

Specific examples include, more particularly, strüverite [$Fe(Ta,Nb)_2O_6.nTiO_2$], ilmenorutile [$Fe(Ta,Nb)$-$nTiO_2$], wherein n is generally from 3 to 150, and the like. Moreover the homologues of the foregoing and those ores which contain a comparatively larger amount of tantalum component are also usable.

The tantalum ores are, preferably, pulverized, for example, to less than 200 mesh size (Tyler) for use with this invention, since the treating rate can be increased in this finely pulverized form.

In the process of this invention, the tantalum ores are at first treated under heating at a temperature above 200° C. in sulfuric acid of a concentration not lower than 50% by weight.

With a concentration of sulfuric acid lower than 50% by weight, the advantageous effects of the invention can not be attained. On the other hand, though fuming sulfuric acid may be used as the higher concentration sulfuric acid, no particular further advantages due to the use of such fuming sulfuric acid can be expected. It is preferred to use a sulfuric acid 60–98% by weight, more preferably, in 80–98% by weight and most preferably in 90–98% by weight.

The amount of the sulfuric acid used is usually 3–30 times, preferably, 3–15 times, more preferably 4–10 times by weight of the tantalum ore raw material. If the amount of the sulfuric acid is too small, mixing with the raw ores is made difficult rendering the temperature distribution therein uneven, by which depositing fast at the reactor wall and bumping result. On the contrary, the use of sulfuric acid in a great amount, although causing no particular trouble, is not advantageous since it increases the size of the apparatus and the cost of the heat-source.

The temperature for the heating is chosen within the range from about 200° C. to up to the boiling point of sulfuric acid, preferably, between about 230°–330° C. more preferably 260°–310° C. If the temperature for the heating is too low, the advantageous effect of this invention can not be obtained and, on the other hand, excessively high temperature may cause operational problems.

After the completion of the heating, the products thus treated are directly subjected to the succeeding reducing step, or the solids are separated from the liquid phase by means of filtration, decantation, etc. and then the separated solids are used in the above reducing step. By the heating of the tantalum ores, water is produced and the components in ores are considered to be converted to certain sulfate forms, but the components dissolved in the concentrate sulfuric acid are negligible during the heating. Therefore, the sulfuric acid recovered through the solid-liquid separation can be re-used as is. Prior to the reusage it is preferred to distil out the produced water so as to keep the sulfuric acid at high concentration. By such treatment, the color of the ores are observed to change from black to yellowish white.

The time required for the heating is usually more than one hour, although it varies depending on the grain size of the raw ores, the temperature for the heating, the concentration and the amount of the sulfuric acid, the ratio between the amount of the tantalum ore and that of the sulfuric acid, and the like.

According to the process of this invention, the products obtained through the above heating are then reduced in a sulfuric acid of concentration lower than 50% by weight using a reducing agent.

The treatment with a reducing agent is carried out under conditions necessary to dissolve titanium component in the sulfuric acid to the greatest possible extent while keeping the tantalum component in an insoluble state.

The concentration of the sulfuric acid for the reducing treatment is usually 5–40% by weight, preferably, 7–30% by weight, and more preferably 10–20% by weight. If the concentration of the sulfuric acid is too low, the reaction rate is decreased and, on the other hand, on excessively high concentration is also undesirable since this decreases the solubility of the titanium component.

The amount of the sulfuric acid used in this reducing step is between 1–20 times and, preferably, 1–10 times by weight, calculated as 100% by weight sulfuric acid, the weight of titanium dioxide in the raw ore. If the amount of the sulfuric acid is too small, the titanium component can not sufficiently be dissolved therein. On the contrary, the use of a great amount of sulfuric acid, although causing no particular trouble, is again disadvantageous since it requires a larger apparatus and produces a greater amount of diluted sulfuric acid solution which requires a costly aftertreatment.

The sulfuric acid used in the reducing treatment may be newly prepared for use. Alternatively, the sulfuric acid at a required concentration can be obtained either by adding water to the products obtained through the foregoing treatment with the concentrated sulfuric acid to adjust the concentration or by mixing water or diluted sulfuric acid with the solid products obtained through the solid-liquid separation of the heated mixture in order to adjust the concentration of sulfuric acid, taking into consideration the concentrated sulfuric acid contained in the solid product.

The reducing treatment is conducted while stirring the products obtained through the treatment with the concentrated sulfuric acid and a reducing agent in the above sulfuric acid.

The reducing agents used herein include a metal selected from iron, zinc, tin and aluminum, preferably iron or aluminum, more preferably iron. The reducing agents may be used in conventional manners, and they may be used in a form of shavings or wire tips.

The amount of the reducing agent used in this reducing treatment may be enough to decrease the valence state of titanium component to the lower state thereof and, concretely, that is 0.2–10 times, preferably 0.3–4 times, and more preferably 0.5–2 times in molar ratio to the titanium oxide in the raw ores.

If the amount of the reducing agent is too small, the advantageous effects of this invention can not be obtained since the titanium component is insufficiently dissolved. On the other hand, the use of the reducing agent in a great amount is also disadvantageous from an economical point of view since no particular advantage can be expected therefrom although it causes no particular trouble.

The temperature for the reducing treatment can optionally be chosen in the range from the room temperature to the boiling point under the reducing conditions, and it is, preferably, 50° C.—boiling point and, more preferably, 85° C.—boiling point.

Since the reduction proceeds rapidly, the time required therefor may be extremely short and can be chosen optionally depending on the amount and kind of the reducing agent.

After the reducing treatment, the resulting products in admixture are separated by means such as decantation or filtration into a solution of the titanium component dissolved in the diluted sulfuric acid and solids in which the content of tantalum component is up-graded. Coagulating agents such as polyacrylamides, sulfides or gelatin and filtration aids such as carbonaceous substances and saw dust can also be used in the above separation step.

When the reducing agents remain in a solid state after reducing treatment, prior to the separation, the remaining solid reducing agent is removed by an ordinary means such as a treatment with acid or a separation utilizing differences in the specific gravity or magnetic properties.

The tantalum concentrates thus produced are, if necessary, washed with diluted mineral acid such as diluted sulfuric acid or diluted hydrochloric acid or water, dried and then calcinated into raw materials for the production of tantalum of high quality.

In this invention, it is possible to mix a part of the obtained tantalum concentrates with tantalum ores as the raw material. Since the filtrate separated after the treatment with a reducing agent contains a small amount of tantalum component together with the titanium component, it is preferable to recover the tantalum component as a solid precipitate in which the tantalum content is up-graded increases by a conventional method, for example, adding water to the filtrate to adjust the concentration of sulfuric acid to lower than 4% and then heating the mixture at the boiling point for a few minutes to cause hydrolysis. The thus recovered solid precipitates may be also mixed with the tantalum ores for use as raw materials.

It has not yet been completely elucidated as to how the titanium dioxide behaves in the process of this invention but the titanium dioxide, it is believed, is converted into a certain sulfate forms by the treatment with the concentrated sulfuric acid at elevated temperature and the resulting sulfates, which scarcely dissolve in the concentrated sulfuric acid, are further converted through reduction into a soluble form in diluted sulfuric acid.

If tantalum ores containing niobium are used as the raw materials for the process of this invention, the niobium component behaves similar to the tantalum component as previously described and is concentrated in the solids proportionate to the titanium component dissolved in the diluted solution of sulfuric acid. Thus, the process of this invention is also applicable to the production of niobium-up-graded products.

Iron, tin, manganese and the like contained, if any, in the starting tantalum ores are selectively dissolved on the side of the diluted sulfuric acid.

The process according to this invention can provide high-grade tantalum concentrates with ease from tantalum ores by using inexpensive sulfuric acid and, therefore, it is of great industrial value.

This invention is in no way limited to the following examples but can be practiced in various other ways within the scope of the appended claims.

In the examples, "parts" and "percentage" means "parts by weight" and "percentage by weight," respectively, unless otherwise specified.

EXAMPLE 1

100 parts of strüverite having the composition shown in column 1 of Table 1 was ground into particles of less than 325 mesh size (Tyler) and stirred together with 400 parts of 96% sulfuric acid at 305° C. for 20 hours. In the course of the above stirring step, 10 parts of water containing 30% sulfuric acid was distilled out.

The treated mixture thus obtained was allowed to cool and then filtered to obtain 190 parts of filtrate having the composition shown in column 2 and 300 parts of solids having the composition shown in the column 3 of Table 1.

The filtered solid products were subjected to reduction by using 80 parts of iron powder (4:1 in molar ratio to the titanium dioxide in the raw ore) together with 1000 parts of water and 300 parts of 96% sulfuric acid under stirring at 85° C. for 3 hours.

The reduction mixture was allowed to cool and then separated through filtration to obtain 1500 parts of filterate and 120 parts of solids. The separated solids were spray-washed with 1000 parts of 10% sulfuric acid and then with 1000 parts of water, dried at 110° C. for 2 hours and calcined at 800° C. for 2 hours to obtain 38 parts of the tantalum concentrate having the composition shown in column 4 of Table 1. The tantalum yield based on the tantalum component in the raw ore was 88%.

TABLE 1

| Column | $TiO_2$ (%) | $Ta_2O_5$ (%) | $Nb_2O_5$ (%) | $Fe_2O_3$ (%) |
|---|---|---|---|---|
| 1 | 47.3 | 16.6 | 10.8 | 8.4 |
| 2 | 0.5 | 0.2 | 0.4 | 0.1 |
| 3 | 13.4 | 4.8 | 3.3 | 2.3 |
| 4 | 8.7 | 38.7 | 14.5 | 1.0 |

COMPARISON EXAMPLE 1

The same starting materials as in Example 1 were subjected to quite the same procedures as in Example 1 but without using the iron powder, and then separated into 1300 parts of filtrate and 250 parts of solids. The separated solid products were washed, dried and then calcined in a manner similar to example 1. As the result, 89 parts of calcination products were obtained having a composition consisting of 51.8% $TiO_2$, 17.7% $Ta_2O_5$, 10.9% $Nb_2O_3$ and 7.4% $Fe_2O_3$, in which the tantalum was not up-graded.

EXAMPLE 2

100 parts of strüverite having the composition shown in column 1 of Table 2 below were ground into particles of less than 325 mesh size (Tyler), mixed with 500 parts of 95% sulfuric acid and then stirred at 296° C. for 10 hours. The treated mixture thus obtained was allowed to cool and filtered to obtain 230 parts of filtrate having the composition shown in column 2 and 340 parts of solids having the composition shown in column 3 of Table 2.

The separated solids were subjected to the reducing treatment by using 80 parts of iron (4:1 in molar ratio to the titanium oxide in the raw ore) together with 1000 parts of water and 100 parts of 96% sulfuric acid under stirring at 104° C. for one hour. At the start of the reduction, the concentration of the sulfuric acid in the system was 16% and the ratio of the total amount of the sulfuric acid, that is the sum of the supplied sulfuric acid and the sulfuric acid containing in the solids, to the amount of the titanium dioxide in the raw material was 4.5% by weight.

Upon the reduction, the reduction mixture was allowed to cool and filtered to obtain 70 parts of solid products. The solid products were washed, dried and then calcined at 800° C. to obtain 26 parts of tantalum concentrates having the composition shown in column 4 of Table 2. The tantalum yield based on the tantalum in the raw ore was 88%.

TABLE 2

| Column | $TiO_2$ (%) | $Ta_2O_5$ (%) | $Nb_2O_5$ (%) | $Fe_2O_3$ (%) |
|---|---|---|---|---|
| 1 | 54.0 | 9.8 | 9.6 | 9.5 |
| 2 | 0.8 | 0.2 | 0.2 | 0.1 |
| 3 | 15.4 | 2.7 | 2.7 | 2.7 |
| 4 | 8.9 | 32.9 | 31.9 | 1.2 |

COMPARISON EXAMPLE 2

The same starting materials were subjected to quite the same procedures as in Example 2 but without using the iron powder and the solid products obtained were washed, dried and calcined. 90 parts of calcined products were obtained and had a composition consisting of 57.5% $TiO_2$, 10.4% $Ta_2O_5$, 10.2% $Nb_2O_5$ and 3.5% $Fe_2O_3$ in which the tantalum was not up-graded.

EXAMPLE 3

100 parts of strüverite having the composition shown in column 1 of Table 3 were ground into particles of less than 325 mesh size, stirred at 285° C. for 10 hours together with 500 parts of 90% sulfuric acid. The treated mixture was allowed to cool and then filtered to obtain 350 parts of solid products. The separated solids were subjected to reduction by using 80 parts of iron powder at 105° C. for one hour with 1000 parts of water and 100 parts of 96% sulfuric acid.

The reduction products were allowed to cool and then separated into solid and liquid products by filtration. The separated solids were again subjected to reduction with 25 parts of iron powder at 105° C. for one hour in a solution of 30 parts of 96% sulfuric acid and 300 parts of water.

The above reduction products were allowed to cool and then separated into solid and liquid products by filtration, and the separated produts were further treated in the same monomer as in Example 2 to obtain 28 parts of tantalum concentrates as shown in column 2 of Table 3. The tantalum yield based on the tantalum in the raw ore was 88%. 31 parts of tantalum concentrates were obtained as shown in column 3 of Table 3, while the latter treatment was carried on after the first reduction was done.

TABLE 3

| Column | $TiO_2$ (%) | $Ta_2O_5$ (%) | $Nb_2O_3$ (%) | $Fe_2O_3$ (%) |
|---|---|---|---|---|
| 1 | 56.5 | 11.2 | 9.4 | 10.1 |
| 2 | 8.5 | 35.3 | 14.0 | 0.7 |
| 3 | 12.2 | 32.3 | 12.4 | 1.0 |

What is claimed is:

1. A process for producing tantalum concentrates from an ore containing tantalum oxides, tantalic acid or salts thereof in combination with rutile-type titanium dioxide in mixed crystals, said process comprising:

(a) admixing said ore with a reagent consisting essentially of an aqueous solution of at least 50% by weight sulfuric acid;

(b) heating the admixture to a temperature within the range of from about 200° C. up to the boiling point of said reagent, with negligible dissolution of ore components;

(c) admixing the treated ore from step (b) with a reducing agent and an aqueous solution of sulfuric acid containing less than 50% by weight sulfuric acid to dissolve the titanium component while leaving the tantalum components in an insoluble state, thereby upgrading the tantalum content in the remaining ore concentrate solids.

2. The process of claim 1 wherein the concentration of the sulfuric acid in step (a) is 50–98% by weight.

3. The process of claim 1, wherein the ore is admixed with a sulfuric acid of a concentration between 60–98% by weight in step (a) and then treated in step (c) with a reducing agent in sulfuric acid of a concentration between 5–40% by weight to dissolve the titanium component.

4. The process of claim 3, wherein the ore is admixed with a sulfuric acid of a concentration between 80–98% by weight in step (a) and then treated in step (c) with a reducing agent in a sulfuric acid of a concentration between 7–30% by weight to dissolve the titanium component.

5. The process of claim 1, wherein the reducing agent is a metal selected from the group consisting of iron, zinc, aluminum and tin.

6. The process of claim 5, wherein the reducing agent is iron or aluminum.

7. The process of claim 6, wherein the reducing agent is iron.

8. The process of claim 1, wherein the molar ratio of the reducing agent to the titanium dioxide in the ores is about 0.1–10.

9. The process of claim 1, wherein the temperature for the heating is between 230°–330° C.

10. The process of claim 1, wherein the temperature in step (c) is from 50° C. to the boiling point of the sulfuric acid.

11. The process as claimed in claim 1, wherein the ore in step (a) is admixed with a sulfuric acid of a concentration between 60–98% by weight and of an amount 3–15 times by weight of said ore and treated in step (c) with a reducing agent in sulfuric acid of a concentration between 5–40% by weight and of an amount 1–10 times by weight, calculated as 100% sulfuric acid, of the titanium dioxide in said ore to dissolve the titanium component.

12. The process as claimed in claim 1, wherein the ore is strüverite and/or limenorutile.

13. The process as claimed in claim 1, wherein the ore is strüverite.

14. The process of claim 1 wherein the heating is step (b) is continued until the color of the ore has changed from black to yellowish white.

15. A process for producing tantalum concentrates from an ore containing tantalum oxides, tantalic acid or salts thereof in combination with rutile-type titanium dioxide in mixed cyrstals, said process comprising:

(a) admixing said ore with a reagent consisting essentially of an aqueous solution of at least 50% by weight sulfuric acid;

(b) heating the admixture to a temperature within the range of from about 200° C. up to the boiling point of said reagent, with negligible dissolution or ore components;

(c) separating solids from the sulfuric acid;

(d) recycling the sulfuric acid from step (c) to step (a);

(e) admixing the solids separated in step (c) with a reducing agent and an aqueous solution of sulfuric acid containing less than 50% by weight sulfuric acid to dissolve the titanium component while leaving the tantalum components in an insoluble state, thereby upgrading the tantalum content in the remaining ore concentrate solids; and (f) separating the upgraded tantalum concentrate solids from the sulfuric acid solution.

16. The process of claim 15, wherein the separated tantalum concentrate from step (f) is partially or entirely recycled to step (a).

17. The process as claimed in claim 15, wherein the sulfuric acid concentration in step (a) is 60–98% by weight and the sulfuric acid concentration in step (e) is 5–40% by weight.

18. The process as claimed in claim 15, wherein the reducing agent is a metal selected from the group consisting of iron, zinc aluminum and tin.

19. The process claimed in claim 18, wherein the reducing agent is iron or aluminum.

20. The process as claimed in claim 19, wherein the reducing agent is iron.

21. The process of claim 15, wherein the heating step (b) is continued until the color of the ore has changed from black to yellowish white.

* * * * *

UNITED STATES PATENT AND TRADEMARK OFFICE

CERTIFICATE OF CORRECTION

PATENT NO. : 4,302,243

DATED : 24 November 1981

INVENTOR(S) : Akio Tamaru & Minoru Kitsumai

It is certified that error appears in the above—identified patent and that said Letters Patent is hereby corrected as shown below:

Col. 1, line 29, "orese" should read ---ores---.

Col. 2, lines 33 and 34, delete "in";

line 62, "concentrate" should read ---concentrated---;

line 65, "distil" should read ---distill---.

Col. 4, line 37, delete "increases"; and line 47, delete "a".

Col. 6, line 5, "containing" should read ---contained---;

line 51, "produts" should read ---products---;

line 52, "monomer" should read ---manner---.

Signed and Sealed this

*Ninth* Day of *March 1982*

[SEAL]

*Attest:*

GERALD J. MOSSINGHOFF

*Attesting Officer*

*Commissioner of Patents and Trademarks*